US006623091B2

(12) United States Patent
Li

(10) Patent No.: US 6,623,091 B2
(45) Date of Patent: Sep. 23, 2003

(54) COMBINED DRAWER WITH GUIDE RAILS

(76) Inventor: Shåohån Li, Kaisi Hardware Co., Ltd., Dachongluduan, Huanshilu, Nansha Developing District, Panyu City, Guangdong Province, 511458 (CN)

( * ) Notice: Subject to any disclaimer, the term of this patent is extended or adjusted under 35 U.S.C. 154(b) by 0 days.

(21) Appl. No.: 10/060,717

(22) Filed: Jan. 30, 2002

(65) Prior Publication Data

US 2003/0034719 A1 Feb. 20, 2003

(30) Foreign Application Priority Data

Aug. 17, 2001 (CN) ..... 1255228

(51) Int. Cl.[7] ..... A47B 88/00
(52) U.S. Cl. ..... 312/330.1
(58) Field of Search ..... 312/330.1, 263, 312/265.5, 265.6, 348.1, 348.2, 348.4, 334.1, 334.7

(56) References Cited

U.S. PATENT DOCUMENTS 1,352,002 A * 9/1920 Jones ..... 312/348.2
4,802,716 A * 2/1989 Rock et al. ..... 312/330.1
5,538,339 A * 7/1996 Rock et al. ..... 312/348.1
5,618,091 A * 4/1997 Huber et al. ..... 312/348.1
5,743,608 A * 4/1998 Johannes ..... 312/348.1
5,823,650 A * 10/1998 Lin ..... 312/348.1

FOREIGN PATENT DOCUMENTS

EP 289256 * 11/1988 ..... 312/348.1
GB 2193430 * 2/1988 ..... 312/348.2

* cited by examiner

*Primary Examiner*—James O. Hansen
(74) *Attorney, Agent, or Firm*—Brown & Michaels, PC

(57) ABSTRACT

A combined drawer with guide rails comprises a left-side board, a right-side board, a rear board, a fixing board, a faceplate, a bottom plate, a roller, a left fixing rail and a right fixing rail. A front vertical limb, a rear vertical limb and a horizontal limb are provided on the sideboards respectively. A stamped gap is provided on the front vertical limb and a fixing pin is provided on the edge of the gap. At least two horizontal ribs are provided on the rear vertical limb. At least two prescribing pins are provided on side boards, and a reinforcing rib is provided on the prescribing pins. At least two fix pins are provided on the horizontal limb. A front runner is provided at the front portion of the rolling runner. The angle α between the front runner and the direction of the direction of the drawer extended is larger than 1°. At least one concave pit is provided on the top of the rolling runner.

2 Claims, 6 Drawing Sheets

COMBINED DRAWER WITH GUIDE RAILS

FIELD OF THE INVENTION

The present invention relates a drawer, especially to a combined drawer with guide rails.

BACKGROUND OF THE INVENTION

Most of the drawers in the prior art are assembled by hand, and it has to fix a rear board and a faceplate on side boards by bolts to manufacture the drawers. It spends longer time, and most of the rear boards and faceplates are made of wood. Although some of the drawer's elements can be assembled quickly without any tools, they are made of plastic, and can not support heavy objects and can not be used widely.

OBJECT OF THE INVENTION

The object of the present invention is to provide a combined drawer with guide rails, which overcomes the shortcomings of the prior art, can be assembled quickly without any tools, and can support heavy objects.

SUMMARY OF THE INVENTION

The present invention provides a combined drawer with guide rails, which comprises a left-side board, a right-side board, a rear board, a fixing board, a face plate, a bottom plate, a roller, a left fixing rail and a right fixing rail. A front vertical limb bending towards inside is provided on the front end of the left-side board and right-side board respectively. A rear vertical limb bending towards inside and corresponding to the front vertical limb is provided on the front end of the left-side board and right-side board respectively. A horizontal limb bending towards inside is provided on the lower portion of the side boards. A rolling runner matching with the sliding orbit is provided on the top of the side boards. A stamped gap is provided on the front vertical limb of the left-side board and right-side board respectively, and a fixing pin bending towards inside is provided on the edge of the gap. At least two horizontal ribs are provided on the rear vertical limb the left-side board and right-side board respectively, and an extended fixing pin is provided along the longitudinal direction of the horizontal ribs. At least two prescribing pins bending towards inside are provided on the rear end of the left-side board and right-side board respectively, and a reinforcing rib is provided on the prescribing pins. At least two fixing pins bending upward are provided on the horizontal limb of the left-side board and right-side board respectively. A front runner is provided at the front portion of rolling runner of the left-side board and fight-side board, and the angle $\alpha$ between the front runner and the direction of the drawer extended is larger than 1°. At least one concave pit is provided on the top of the rolling runner of the left-side board and right-side board respectively.

According to the combined drawer with guide rails of the present invention, the cross section of horizontal rib on the left-side board and right-side board is in the shape of hemicycle; the cross section of the reinforcing rib of the prescribing pin on the left-side board and right-side board is in the shape of rhombic; and the cross section of concave pit on the left-side board and right-side board is in the shape of triangular.

DETAILED DESCRIPTION OF THE INVENTION

Figure 1:
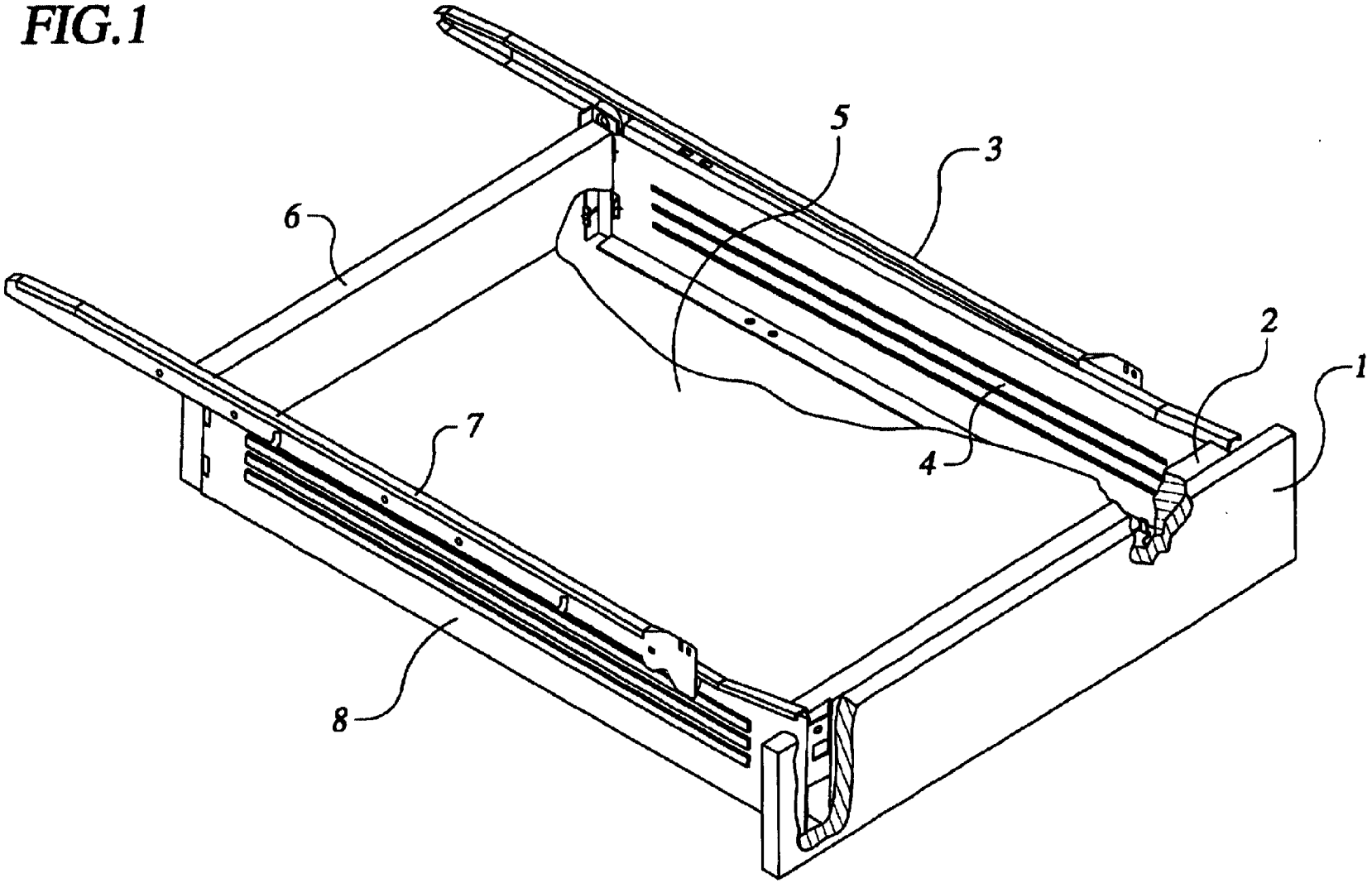
FIG. 1 is a perspective view of the combined drawer with guide rails of the present invention.
Figure 2:
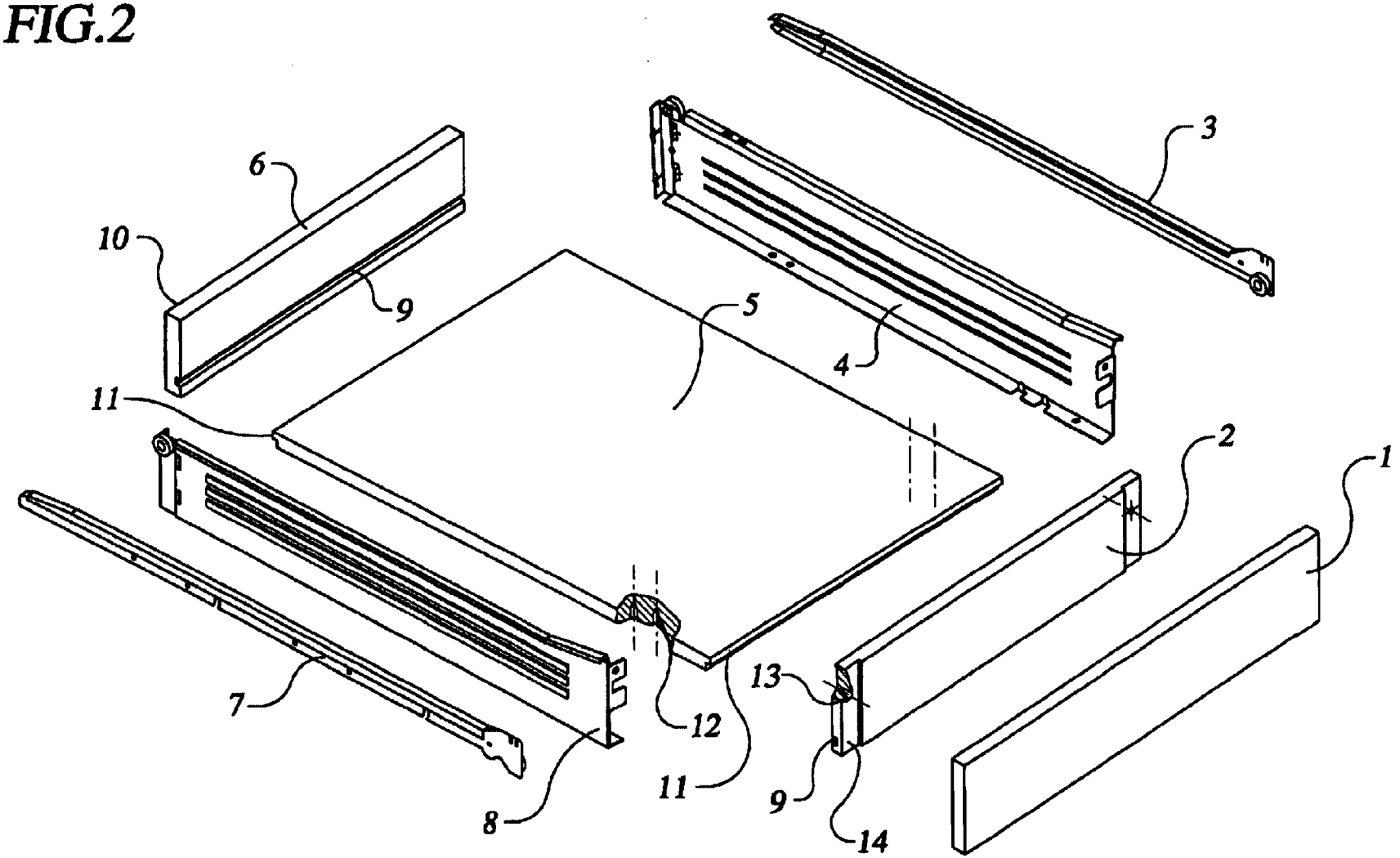
FIG. 2 is a perspective view of the combined drawer with guide rails of the present invention showing the state of the separated details, FIG 3. is a perspective view from the direction of southeast of right side board 4 in FIG 1.
Figure 3:
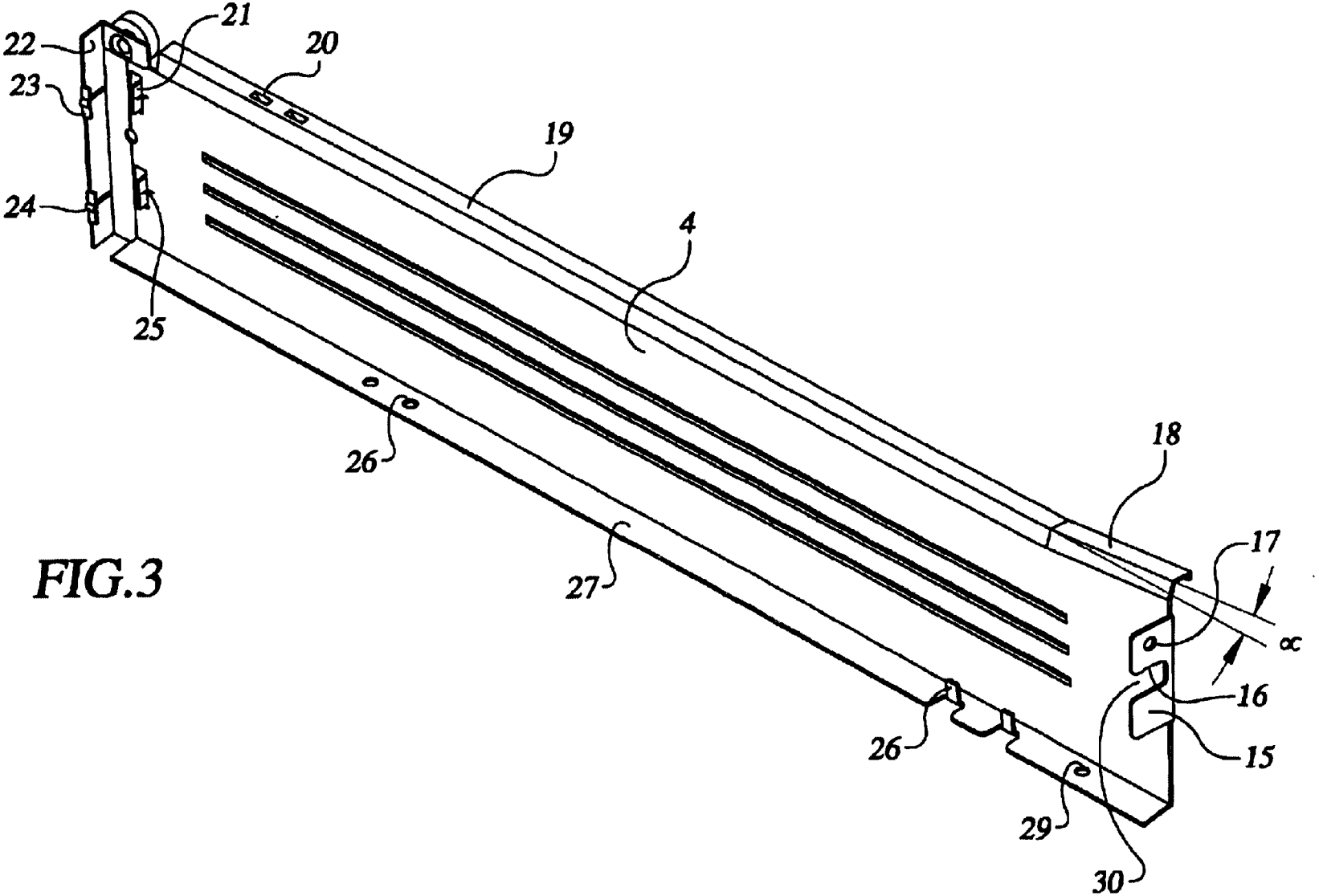
Figure 4:
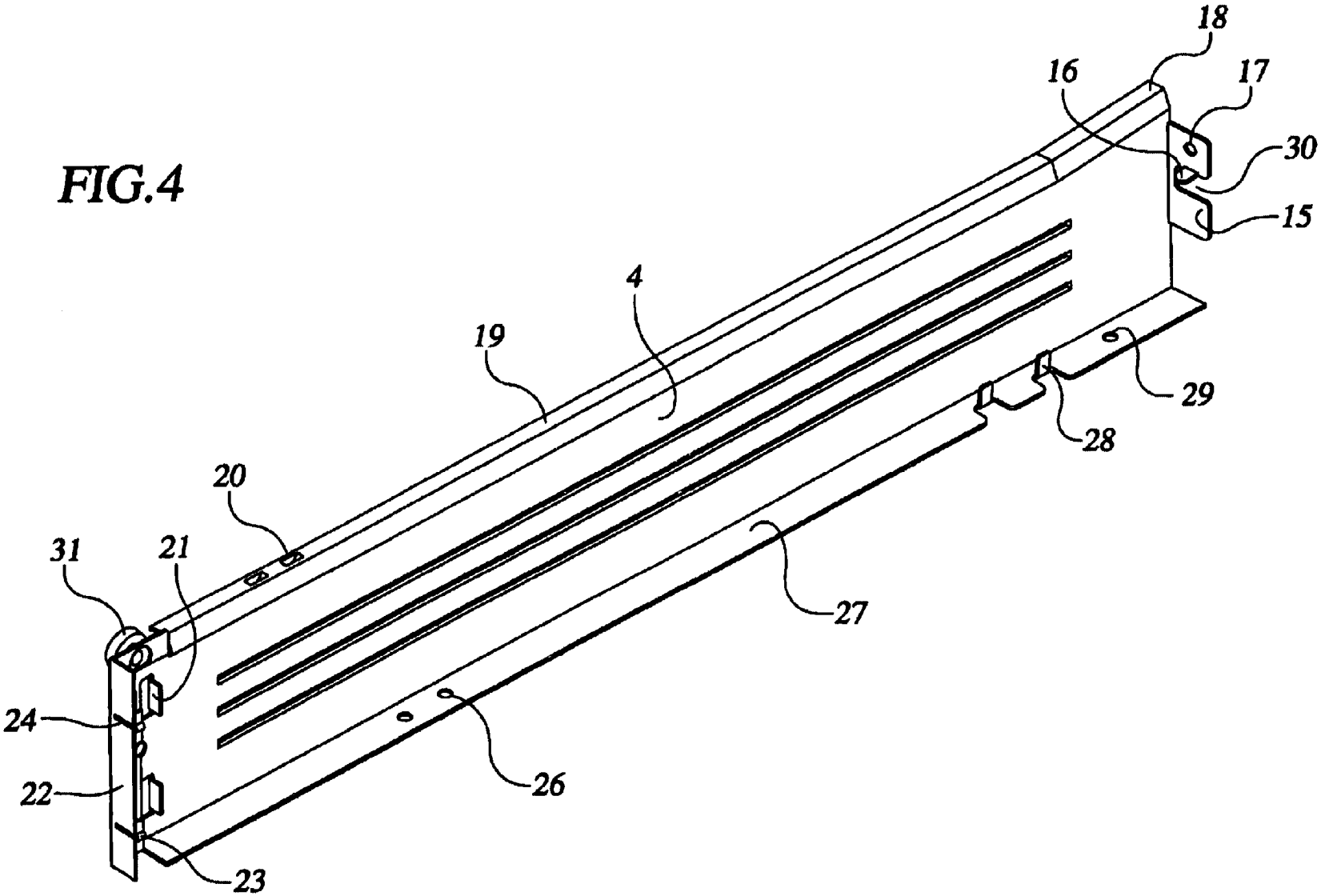
FIG. 4 is a perspective view from the direction of southwest of right side board 4 in FIG. 1.
Figure 5:
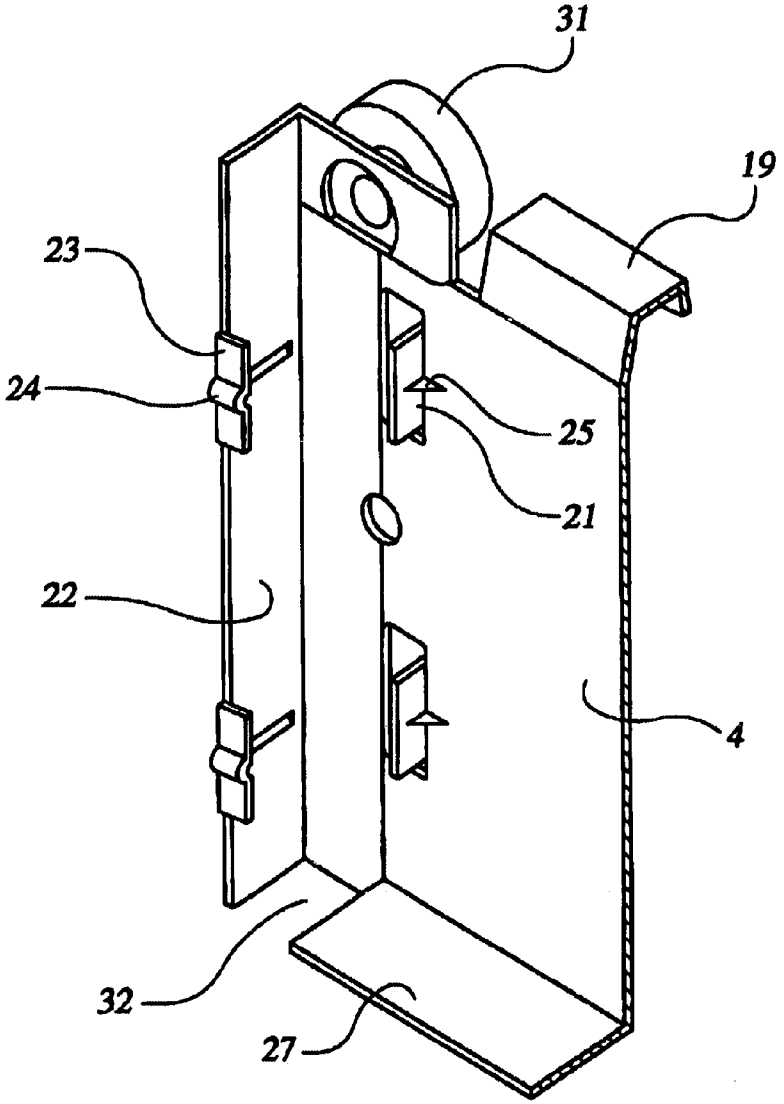
FIG. 5 is a perspective view from the direction of southeast of the rear of right side board 4 in FIG. 1.
Figure 6:
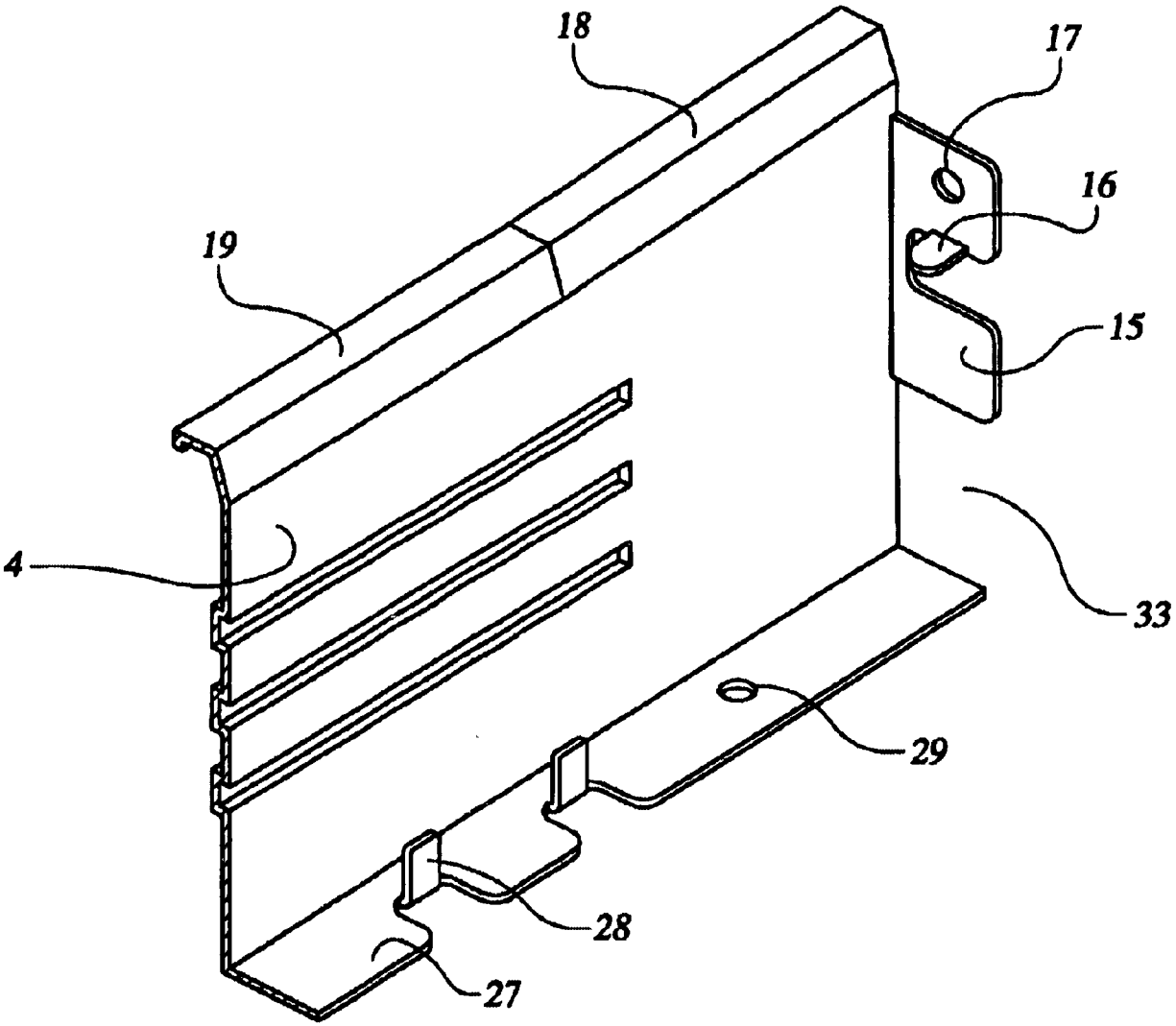
FIG. 6 is a perspective view from the southwest of the front of right side board 4 in FIG. 1.

FIGS. 1 to 6 show a preferred embodiment of the combined drawer with guide rails of the present invention. As shown by FIGS. 1 to 6, the combined drawer with guide rails of the present invention comprise a left-side board 8, a right-side board 4, a fixing board 2, a left fixing rail 7, a right fixing rail 3, a rear board 6, a bottom plate 5, a face plate 1, and a roller 31. The left fixing rail 7 and right fixing rail 3 are fixed on the upside portion of the left-side board 8 and the right-side board 4 respectively; the face plate 1 is fixed on the front of the fixing board 2. A front vertical limb 15 bending towards inside is provided on the front end of the left-side board 8 and right side board 4 respectively, which closes to the faceplate 1. A rear vertical limb 22 bending towards inside is provided on the lower portion of the left-side board 8 and right-side board 4 respectively, which corresponds to the front vertical limb 15. A horizontal limb 27 bending towards inside is provided on the lower portion of the side boards 8 and 4 respectively. A rolling runner 19 matching with the sliding orbit is provided on the top of the side boards 8 and 4 respectively. A stamped square gap 30 and a horizontal hole 17 are provided at the center of the front vertical limb 15 of the left-side board 8 and right-side board 4 respectively, and a square horizontal fixing pin 16 bending backward is provided on the edge of the gap 30. Two horizontal ribs 24, whose cross section is in the shape of hemicycle, are provided on the rear vertical limb 22 of the right-side board 4 and left-side board 8 respectively. Two prescribing pins 21 bending towards inside are provided on the rear end of the left-side board 8 and right-side board 4 respectively. A reinforce rib 25, whose cross-section is in the shape of rhombus, is provided on the prescribing pins 21. Two fixing pins 28 bending upward and one vertical hole 29 are provided on the horizontal limb 27 of the left-side board 8 and right-side board 4 respectively. A front runner 18 is provided at the front of the rolling runner 19 of the left-side board 8 and right-side board 4 respectively. The angle $\alpha$ between the front runner 18 of rolling runner 19 of the left-side board 8 and right-side board 4 and the direction of the drawer extended is larger than 1°. The distance between the rear surface of the prescribing pins 21 and the front surface of the rear vertical limb 22 equals to the thickness of the rear board 6. Two concave pits 20, whose cross section is in shape of triangular, are provided on the top of the rolling runner 19. A vertical through slot 10 (as shown in FIG. 2) is provided on the back of the rear board 6, and the position of the vertical trough slot 10 corresponds to the position of the fixing pin 23 provided on left-side board 8 and right-side board 4 respectively. A horizontal through trough 9 is provided on the lower portion of the rear board 6. Two symmetrical installing holes 13 are provided on the front of the fixing board 2, and the position of the installing hole 13 corresponds to the position of fixing pin 16 provided on left-side board 8 and right-side board 4 respectively. A horizontal through trough 9 is provided on the front lower portion of the fix board 2. One vertical bulgy edge 14 is provided on the front and the rear end of the bottom plate 5 respectively. One horizontal bulgy edge 11 is provided on the front and the rear of the bottom plate 5. Two fixing holes 12 are provided on the bottom plate 5 respectively. The position of the fixing holes 12 correspond to the position of upward fixing pin 28 provided on left-side board 8 and the right-side board 4 respectively. The two vertical through soles 10 are imbedded to the fixing pin 23 of the left-side board 8 and right-side board 4 respectively, and are fixed by the prescribing pin 21 of the left-side board 8 and right-side board 4 respectively. The bottom plate 5 is supported on the horizontal limb 27 of the left-side board 8 and right-side board 4, and the horizontal bulgy edge 11 on the rear end is imbedded in the horizontal through trough 9 of the rear board 6. The fixing hole 12 is sleeved on the upward fixing pin 28 of the left side 8 board and right-side board 4 respectively. The fixing board 2 contacts the inner surface of front vertical limb 15 of the left-side board 8 and right-side board 4. The horizontal through trough 9, which is on the back of the fixing board 2, scarves on the horizontal bulgy edge 11 of the front of bottom plate 5. The fixing pin 16 of the left-side board 8 and right-side board 4 is inserted in the installing hole 13 on the fixing board 2 and is fixed. A clearance 32 (as shown in FIG. 5) is provided between the lower portion of the rear vertical limb 22 and the rear of the horizontal limb 27 of the left-side 8 board and right-side board 4. A bigger clearance 33 (as shown in FIG. 6), which is larger than the thickness of the fixing board 2, is provided between the horizontal limb 27 and the lower portion of the front vertical limb 15 of the left-side 8 board and right-side board 4.

The drawer is assembled according to the following procedures. Firstly, the rear board 6 is inserted into a space between the fixing pin 23 and the prescribing pin 21 of the left-side 8 board and right-side board 4. Secondly, the horizontal bulgy edge 11 on the rear of the bottom plate 5 is inserted into the horizontal through tough 9 via the clearance 32, which is in the front of the rear board 6. Then the fixing hole 12, which is on the ret board 6, is sleeved onto the upward fixing pin 28, which is on the horizontal limb of the left-side 8 board and tight-side board 4. In this way, the left-side board 8, the right side board 4; the rear board 6 and the bottom plate 5 are put together. After that, the fix board 2 is put on the back end of the front vertical limb 15 and the top of the fixing board 2 leans backward. The lower portion of the fixing board 2 is inserted into the bigger clearance 33, and the fixing board 2 is rotated reversibly to make the through 9 sleeve onto the horizontal bulgy edge of the bottom plate 5. At the same time, the installing hole 13 on the fixing board 2 sleeves onto the pin 16 of the left-side board 8 and the right-side board 4. Finally, the sideboards 8 and 4 are fixed onto the fixing board 2 and the bottom plate 5 by self-tapping screw via the horizontal hole 17, vertical hole 29 and the elliptic hole 26.

The combined drawer with guide rails of the present invention has the following advantages: it can be assembled quickly without any tool, and the drawer is made of stamped steel plates, its manufacture process is simple, it can support heavy objects, and it is suitable for an lands of application.

What is claimed is:

1. A combined drawer with guide rails, comprising a left-side board (8); a fight-side board (4); a rear board (6); a fixing board (2); a faceplate (1); a bottom plate (5); a roller (31); a left fixing rail (7) and a right fixing rail (3); a front vertical limb (15), bent inwards toward an interior of the drawer, on the front end of the left-side board (8) and right-side board (4) respectively; a rear vertical limb (22), bent inwards toward the interior of the drawer, on the rear end of the side boards (8, 4); a horizontal limb (27), bent inwards toward the interior of the drawer, on the lower portion of the side boards (8, 4); and a rolling runner (19), matching with a sliding orbit, on the top of the side boards (8, 4), characterized in that said combined drawer further comprises:

a. a stamped gap (30) provided on the front vertical limb (15) of the left-side board (8) and right-side board (4) respectively; and a fixing pin (16), bent inwards toward the interior of the drawer, on the edge of the gap (30);

b. at least two horizontal ribs (24) provided on the rear vertical limb (22) of the left-side board (8) and the right-side board (4) respectively; and an extended fixing pin (23), bent inwards toward the interior of the drawer, along the longitudinal direction of the horizontal ribs (24);

c. at least two prescribing pins (21), bent inward toward the interior of the drawer, on the rear end of the left-side board (8) and right-side board (4) respectively, and a reinforcing rib (25) provided on the prescribing pins (21);

d. at least two fixing pins (28), bent upward toward a top of the drawer, on the horizontal limb (27) of the left-side board (8) and right-side board (4) respectively;

e. a front runner (18) provided at the front portion of the rolling runner (19) of the left-side board (8) and right-side board (4); and an angle $\alpha$ between the front runner (18) and the extending direction of the drawer larger than 1°; and f. at least one concave pit (20) provided on the top of the rolling runner (19) of the left-side board (8) and right-side board (4) respectively.

2. A combined drawer with guide rails as claimed in claim 1, further characterized in that:

a. a cross section of the horizontal rib (24) on the left-side board (8) and right-side board (4) is hemicycle-shaped;

b. a cross section of the reinforcing rib (25) of the prescribing pin (21) on the left-side board (8) and right-side board (4) is rhombus-shaped; and c. a cross section of the concave pit (20) on the left-side board (8) and right-side board (4) is triangle shaped.

* * * * *